US007547376B2

(12) United States Patent
Satoh

(10) Patent No.: US 7,547,376 B2
(45) Date of Patent: Jun. 16, 2009

(54) PAPER IMPROVER

(75) Inventor: Haruyuki Satoh, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/521,568

(22) PCT Filed: Jul. 17, 2003

(86) PCT No.: PCT/JP03/09107

§ 371 (c)(1),
(2), (4) Date: Sep. 28, 2005

(87) PCT Pub. No.: WO2004/009904

PCT Pub. Date: Jan. 29, 2004

(65) Prior Publication Data

US 2006/0102306 A1 May 18, 2006

(30) Foreign Application Priority Data

Jul. 19, 2002 (JP) ..... 2002-211358

(51) Int. Cl.
*D21H 17/37* (2006.01)
*D21H 17/45* (2006.01)
*D21H 21/22* (2006.01)

(52) U.S. Cl. ..... 162/168.3; 162/158; 162/164.6; 162/183; 526/72; 526/310

(58) Field of Classification Search ..... 162/168.3, 162/158, 164.6, 183; 526/72, 310
See application file for complete search history.

(56) References Cited

U.S. PATENT DOCUMENTS

| | | | | | |
|---|---|---|---|---|---|
| RE28,474 | E | * | 7/1975 | Anderson et al. | 523/336 |
| 4,305,860 | A | * | 12/1981 | Iovine et al. | 162/164.5 |
| 4,845,149 | A | * | 7/1989 | Frazee | 524/458 |
| 5,167,766 | A | * | 12/1992 | Honig et al. | 162/164.1 |
| 5,171,808 | A | * | 12/1992 | Ryles et al. | 526/264 |
| 5,374,336 | A | * | 12/1994 | Lin et al. | 162/168.3 |
| 5,431,783 | A | * | 7/1995 | Honig | 162/164.1 |
| 5,571,380 | A | * | 11/1996 | Fallon | 162/168.2 |
| 5,747,392 | A | * | 5/1998 | Xiao et al. | 442/82 |
| 6,020,422 | A | * | 2/2000 | Connors et al. | 524/716 |
| 6,303,002 | B1 | * | 10/2001 | Linhart et al. | 162/199 |
| 6,372,089 | B1 | * | 4/2002 | Keiser et al. | 162/181.6 |
| 6,417,268 | B1 | * | 7/2002 | Zhang et al. | 524/833 |
| 2003/0022568 | A1 | * | 1/2003 | Branham et al. | 442/59 |

FOREIGN PATENT DOCUMENTS

| | | | |
|---|---|---|---|
| EP | 1 016 755 | A2 | 7/2000 |
| EP | 1247898 | A1 * | 10/2002 |
| JP | 2971447 | A | 8/1999 |
| JP | 11-350380 | A | 12/1999 |
| JP | 2001-123391 | A | 5/2001 |
| JP | 2001-164497 | A | 6/2001 |
| JP | 2001-248100 | A | 9/2001 |
| JP | 2002-115199 | A | 4/2002 |
| JP | 2002-115199 | A | 4/2002 |
| WO | WO-98/03730 | A1 | 1/1998 |

OTHER PUBLICATIONS

E.W. Haylock, Paper Its making, merchanting and usage, 3rd ed, The National Association of Paper Merchants, London, 1974, pp. 69-73.*
Smook, Gary A., Handbook for Pulp and Paper Technologists, 2nd ed. Angus Wilde Publications, 1992, p. 324.*

* cited by examiner

*Primary Examiner*—Steven P Griffin
*Assistant Examiner*—Dennis Cordray
(74) *Attorney, Agent, or Firm*—Birch, Stewart, Kolasch & Birch, LLP

(57) ABSTRACT

The invention provides a paper quality improver for papermaking that allows improvement in the bulky value and the optical properties such as brightness and opacity as well as in the paper strength of a sheet obtained by papermaking a pulp material. The paper quality improver for papermaking is a paper quality improver for papermaking containing a copolymer (A) having a constituent unit derived from at least one nonionic monomer having a solubility parameter of 20.5 $(MPa)^{1/2}$ or less and a constituent unit derived from at least one anionic or cationic monomer and a surfactant (B) at a certain ratio, the quality improver providing at least one paper quality improving effect of: (i) standard improved bulky value: 0.02 g/cm or more; (ii) standard improved opacity: 1.0 point or more; and (iii) standard improved brightness: 0.5 point or more.

12 Claims, No Drawings

PAPER IMPROVER

This application is a 371 of PCT/JPO3/09107, filed 07/17/2003 and claims priority to Japanese Application No. 2002-211358, filed 07/19/2002

FIELD OF THE INVENTION

The invention relates to a paper quality improver for papermaking that allows improvement in the bulky value and the optical properties such as brightness and opacity as well as in the paper strength of a sheet obtained by papermaking a pulp material.

BACKGROUND OF THE INVENTION

There exists an increasing demand for reduction in the amount of pulp used in paper making for protection of the global environment and consequently in the weight of paper and increased used of waste paper pulp. However, the reduction in the amount of pulp used in paper leads to a paper thinner and reduced in opacity, resulting in deterioration in the quality of the paper. In addition, weight saving by reduction in the amount of pulp used for paper making decreases the stiffness of the resulting paper, which is unfavorable especially for papers demanding a higher stiffness such as cardboard and the like, which is proportional to the thickness to the third power. On the other hand, increased use of waste paper pulp leads to deterioration in brightness due to the ink remaining in the waste paper pulp or the like and in opacity due to the decrease in paper thickness caused by the wear in pulp bulky value during recycling. As a result, reduction in the amount of pulp and increase in the amount of waste paper pulp used in paper in combination leads to further decrease in the opacity and brightness of the paper obtained. Further, deinking and bleaching of waste paper pulp, which is the primary cause of the deterioration in brightness, for improvement in the brightness unfavorably leads to further deterioration in the opacity of paper.

Various bulky value-improving processes have been proposed to reduce the weight of paper, but prevent the thickness from decreasing. An example thereof is a method of reducing press pressure, but the process contains a problem of reduced surface smoothness and thus reduced printability. Other examples include methods of using a crosslinked pulp, blending a synthetic fiber, adding an inorganic or other filler between pulp fibers, and providing voids between them, which often result in incapability of recycling the pulp and deterioration in the smoothness of the resulting paper. A paper-bulking agent is disclosed in JP-B 2971447, but carries a problem of insufficient paper strength.

Also known is additives used during papermaking that allow improvement in the brightness, opacity, and bulking property of paper and is more effective in improving paper strength than conventional paper bulking agents (JP-A Nos. 2002-115199, 2001-248100, etc.).

In the papermaking industry, there exists a need for a paper quality improver that enables production of a bulkier paper under a high-speed high-shear papermaking condition. The high-speed papermaking is not the papermaking under a static condition wherein the pulp is diluted in a great amount of water and filtered by the weight of water as described in the conventional TAPPI papermaking technology, but the papermaking under a dynamic condition wherein the pulp slurry is supplied onto a traveling wire surface and papermade under a high-shear force in a production machine; and can be carried out in a orientational paper machine or the like in laboratory.

Alternatively, the method of adding an inorganic filler such as calcium carbonate, kaolin, white carbon, or the like in a greater amount (e.g. 5 to 20% by weight) has been also practiced in the industry for improvement in opacity and brightness. However, simple addition of an inorganic filler in a greater amount leads to increase in the weight of paper. If the amount of pulp used is reduced, addition of an inorganic filler cancels out the weight reduction and cannot achieve the reduction in the weight of paper. In particular, when an inorganic filler is added to a waste paper pulp, the amount of the inorganic filler increases, making it more difficult to achieve the reduction in the weight of paper.

SUMMARY OF THE INVENTION

A purpose of the present invention is to provide a paper quality improver for papermaking more effective in improving paper strength than conventional paper bulking agents that allow at least one improvement in the brightness, opacity, or bulky value of paper when added in any step prior to the papermaking step under a high-speed papermaking condition.

The invention provides a paper quality improver for papermaking containing a copolymer (A) having a constituent unit derived from at least one nonionic monomer having a solubility parameter of 20.5 $(MPa)^{1/2}$ or less and a constituent unit derived from at least one anionic or cationic monomer and a surfactant (B) at a (A)/(B) ratio in the range of 99/1 to 1/99 (weight ratio), the quality improver providing at least one paper quality improving effect of the followings (i), (ii), and (iii):

(i) standard improved bulky value: 0.02 $g/cm^3$ or more;

(ii) standard improved opacity: 1.0 point or more; and (iii) standard improved brightness: 0.5 point or more.

The invention also provides a paper quality improver for papermaking, containing a copolymer (A) having a constituent unit derived from at least one nonionic unsaturated monomer having a solubility parameter of 20.5 $(MPa)^{1/2}$ or less and a constituent unit derived from at least one anionic or cationic monomer and a surfactant (B) at an (A)/(B) ratio in the range of 99/1 to 1/99 (weight ratio), the quality improver providing at least one paper quality improving effect of the followings (i), (ii), and (iii):

(i) standard improved bulky value: 0.02 $g/cm^3$ or more;

(ii) standard improved opacity: 1.0 point or more; and (iii) standard improved brightness: 0.5 point or more.

In addition, the invention provides a paper quality improver for papermaking containing a copolymer (A) having a constituent unit derived from at least one nonionic monomer having a solubility parameter of 20.5 $(MPa)^{1/2}$ or less in a total amount of 5 to 84% by weight in the polymer and a constituent unit derived from at least one anionic or cationic monomer in a total amount of 1 to 80% by weight in the polymer and a surfactant (B) at an (A)/(B) ratio in the range of 99/1 to 1/99 (weight ratio).

Methods of determining the standard improved bulky value, the standard improved brightness and the standard improved opacity in the invention will be described below in detail.

<Method of Determining Standard Improved Bulky Value>

(1) A bleached hardwood pulp derived from a beech (hereinafter, referred to as LBKP) was cut into pieces of 5 cm ×5 cm in size, and a certain amount of the pulp is beaten in a beater at 25±3° C. until the slurry has a Canadian Standard Freeness (JIS P3121) of 410±20 ml, to give an LBKP slurry having a pulp concentration of 0.4% by weight.

To the pulp slurry preadjusted to a concentration so that the resulting sheet has a basis weight of 84±2 g/m$^2$ after conditioning, 2.0 parts by weight of a paper quality improver for papermaking containing copolymer (A) and surfactant (B) at a ratio in the range of 1/99 to 99/1 (weight ratio) was added with respect to 100 parts by weight of the pulp, and the mixture was papermade in a laboratory orientational paper machine (manufactured by Kumagai Riki Kogyo Co., Ltd.) employing a 80 mesh wire under the following condition, to give a wet sheet.

(Papermaking Condition)
Papermaking speed: 800 m/min
Spraying pressure: 0.1 MPa
Spraying nozzle: small
Spraying nozzle angle: 85°
Spraying nozzle distance: 40 mm
Dehydration speed: 500 r/min
Dehydration period: 30 seconds.

The wet sheet obtained is cut into three papers identical in size, each of which is then placed and coached between two production filter papers No. 26 (270 mm×270 mm) manufactured by Advantech Toyo Kaisha Ltd., and additionally with two coach plates. Each sheet is pressed between two new filter papers under a pressured of 340±10 kPa for 5 minutes. After pressing, the sheet is removed and dried at 105±3° C. for 2 minutes by using a mirror surface dryer. The dry sheet is conditioned under the environment of 23° C. and a humidity of 50% for 5 hours or more. The conditioned sheet is further cut into pieces of 150×150 mm in size.

(2) After measuring the weight of the cut sheet weight, the basis weight (g/m$^2$) of the paper is obtained according to the following equation (3), $$\text{Basis weight (g/m}^3\text{)=Sheet weight/0.0225} \quad (3)$$

Then, the thickness of the conditioned sheet is determined at five or more points under a pressure of 53.9±4.9 kPa by using a paper micrometer, and the average thus obtained is designated as the thickness (mm) of the paper.

(3) From the basis weight and the thickness obtained above, the bulk density d (g/cm$^3$) is calculated according to the following Formula (4).

$$\text{Bulk density } d\text{=Basis weight/Thickness/1,000} \quad (4)$$

Separately, a sheet is prepared similarly except that the sheet contains no paper quality improver for papermaking, and the bulk density thereof obtained similarly is designated as $d_0$.

(4) From the apparent densities, d and $d_0$, thus obtained, the improvement in bulky value is calculated according to the following equation (5).

$$\text{Standard improved bulky value (g/cm}^3\text{)}=d_0-d \quad (5).$$

<Method of Determining Standard Improved Brightness>

(1) A conditioned sheet is prepared in the same manner as that described in method (1) of determining the standard improved bulky value.

(2) The brightness B of the conditioned sheet is determined according to Hunter's brightness in JIS P8123. Separately, a sheet is prepared similarly except that the sheet contains no paper quality improver for papermaking, and the brightness thereof obtained similarly is designated as $B_0$.

(3) From the brightnesses, B and $B_0$, thus obtained, the standard improved brightness is calculated according to the following equation (6).

$$\text{Standard improved brightness (point)}=B-B_0 \quad (6).$$

<Method of Determining Standard Improved Opacity>

(1) A conditioned sheet is prepared in the same manner as that described in method (1) of determining the standard improved bulky value.

(2) The opacity P of the conditioned sheet is determined according to the method of JIS P8133A. Separately, a sheet is prepared similarly except that the sheet contains no paper quality improver for papermaking, and the opacity thereof obtained similarly is designated as $P_0$.

(3) From the opacities, P and $P_0$, thus obtained, the standard improved opacity is calculated according to the following equation (7).

$$\text{Standard improved opacity (point)}=P-P_0 \quad (7).$$

In addition, the paper quality improver for papermaking according to the invention is preferably an improver that is effective in providing the resulting sheet with a standard improved ratio in burst index defined here in the present specification of −3,000 or more. The burst index usually decreases when the bulk density of paper is kept constant and the bulky value thereof increased. The standard improved ratio in burst index is an indicator of how much the burst index is retained when the bulky value is increased under the measuring condition of the standard improved bulky value. A positive value means that the burst index increases, and a negative value that the burst index decreases; in the invention, a standard improved ratio in burst index is preferably −3,000 or more from the viewpoint of improvement in bulky value and retention of burst index. The method of determining the standard improved ratio in burst index is as follows:

<Method of Determining the Standard Improved Ratio in Burst Index>

(1) A conditioned sheet is prepared in the same manner as that described in method (1) of determining the standard (2) The burst index "s" of the conditioned sheet is determined according to the method of JIS P8112. Separately, a sheet is prepared similarly except that the sheet contains no paper quality improver for papermaking, and the burst index thereof obtained similarly is designated as $S_0$. Separately, the standard improved bulky value of each sheet is determined according to the method above.

(4) If the standard improved bulky value is 0 g/cm$^3$ or less, the standard improved ratio in burst index is regarded as indefinable. Alternatively, if the standard improved bulky value is greater than 0 g/cm$^3$, the standard improved ratio in burst index is calculated according to the following equation (8).

$$\text{Standard improved ratio in burst index}=(s/S_0\times100-100)/\text{Standard improved bulky value} \quad (8).$$

In this manner, advantages of the paper quality improver according to the invention can be identified easily by determining the standard improved bulky value, standard brightness, and standard opacity, as well as the standard improved ratio in burst index of the sheets employing a paper quality improver containing a particular copolymer and a surfactant.

The invention also relates to a process for producing a pulp sheet, including the steps of adding a paper quality improver for papermaking according to the invention in any step before the papermaking step and papermaking the pulp slurry at a papermaking speed of 200 m/min or more. The invention additionally relates a pulp sheet containing the paper quality improver for papermaking according to the invention.

DETAILED DESCRIPTION OF THE INVENTION

The mechanisms underlying the advantageous effects of the invention are yet to be understood, but seem to be the followings: When the copolymer (A) according to the invention is added to a pulp slurry, the anionic and cationic portions of the electric charge-carrying copolymer (A) are adsorbed on the pulp fiber, while the structure therein derived from a nonionic monomer having a solubility parameter of 20.5 $(MPa)^{1/2}$ or less, which is hydrophobic in nature, stick its hydrophobic portion out of the surface, hydrophobilizing the pulp surface. As a result, the interfacial tension between pulp and aqueous solution increases, expanding the distance among pulps during papermaking and hence leading to a bulkier pulp sheet and improvement in opacity and brightness due to increase in optical reflectance. However, under a high-speed papermaking or a high-shear-force condition, adsorption of the copolymer (A) on the pulp becomes heterogeneous, resulting in inadequate hydrophobilization of the pulp surface and smaller improvement in bulky value. It seems that the interaction between the copolymer (A) and the surfactant (B) enables efficient adsorption of the copolymer (A) on the pulp surface and consequently efficient hydrophobilization of the pulp surface even under the high-shear condition. In addition, uniform distribution of the copolymer (A) on the pulp surface and adsorption thereof in the microparticlar state seem to be also responsible for the increase in paper strength.

On the other hand, even when the distance among pulps is increased, the bonding force among pulps is kept constant and the paper strength is rather increased, because the structure derived from the monomer having a solubility parameter of 26.6 $(MPa)^{1/2}$ or more in the copolymer is hydrophilic and the more hydrophilic portions thereof retain a strong hydrogen bond interaction with pulps. The paper strength seems to be increased more effectively when a crosslinkable monomer is introduced, because of the increase in the molecular weight and molecule size of the copolymer, allowing more facile bonding among pulps.

The copolymer (A) for use in the invention is a copolymer having a constituent unit derived from at least one nonionic monomer having a solubility parameter of 20.5 $(MPa)^{1/2}$ or less and a constituent unit derived from at least one anionic or cationic monomer, and examples thereof include vinyl polymers, polyesters, polysaccharide derivatives, and the like. The copolymer (A) preferably has a constituent unit derived from at least one nonionic unsaturated monomer having a solubility parameter of 20.5 $(MPa)^{1/2}$ or less and a constituent unit derived from at least one anionic or cationic monomer, and examples thereof include vinyl polymers and the like.

The solubility parameter a used in the present specification is a value described in POLYMER HANDBOOK (J, Brandrup and E. H. Immergut, third edition). When the solubility parameter of a particular structure is not available, a value calculated according to the method described in Chapter VII/519 of the same book is used. Namely, the solubility parameter is calculated according to the following equation:

$$\sigma=((H-R\times 298.15)/V)^{1/2} \text{ [unit: } (cal/m^3)^{1/2} \text{ or } \times 2.046\ (MPa)^{1/2}]$$

H: Enthalpy of vaporization [unit: (cal/mol) or (×4.186J/mol)]

R: Gas constant [unit: (1.98719 cal/K-mol) or (1.98719×4.186 J/K-mol)]

V: Molar volume $(cm^3/mol)$

In the present specification, H is obtained from the standard boiling point $T_b$ by using the following empirical equation:

$$H=-2{,}950+23.7\ T_b+0.020\ T_b^2 \text{ (unit: (cal/mol) or (×4.186 J/mol))}$$

$T_b$: Standard boiling point [unit: K]

The standard boiling point $T_b$ of a monomer is determined by using the values described in the reagent catalog of Aldrich (2000-2001: JAPAN), and when the boiling point thereof is shown only under reduced pressure, the boiling point under normal pressure is calculated by using the pressure/temperature conversion table in the appendix table of the same catalog. When the monomer is not listed or the boiling point thereof is not shown in the catalog, the solubility parameter a at 25° C. was obtained by the Group Contribution method, according to the following Formula:

$$\sigma=\Sigma Fi/V$$

F: Molar attraction constant [unit: $(cal/m^3)^{1/2}cm^3/mol$ or $\times 2.046\ (MPa)^{1/2}cm^3/mol$]

In the present specification, Hoy's value was used as F. Hereinafter, an example of calculating the solubility parameter a of a monomer is shown.

CALCULATION EXAMPLE 1

Monomer: acrylamide (molecular weight: 71.08; $T_b$: 235° C.: and specific gravity: 1.12)

$$H=-2{,}950+23.7\times 508.15+0.020\times(508.15)^2=14257.9$$

$$V=71.08/1.12=63.4$$

$$\sigma=((H-1.98719\times 298.15)/V)^{1/2}=14.7\ (cal\ m^3)^{1/2}=30.1\ (MPa)^{1/2}$$

CALCULATION EXAMPLE 2

Monomer: tertiary-octyl acrylamide (molecular weight: 183.3; specific gravity: 0.86)

Group Number F (unit: $(cal/m^3)^{1/2}cm^3/mol$ or $\times 2.046\ (MPa)^{1/2}cm^3/mol$)

| | | |
|---|---|---|
| $—CH_3$ | 5 | 148.3 |
| $—CH_2—$ | 1 | 131.5 |
| >CH— | 1 | 85.99 |
| >C< | 2 | 32.03 |
| $H_2C=$ | 1 | 126.54 |
| —CO— | 1 | 262.96 |
| —NH— | 1 | 180.03 |

Basic Value 135.1

$$\sigma=(148.3\times 5+131.5+85.99+32.03\times 2+126.54+262.96+180.03+135.1)/(183.3/0.86)=8.1\ (cal/M^3)^{1/2}=16.6\ (MPa)^{1/2}.$$

The nonionic monomer according to the present specification is a monomer that does not carry an anionic or cationic charge at any pH. The anionic or cationic monomer according to present specification is not restricted to a monomer that always carries an anionic or cationic charge and include a monomer that carries an ionic charge according to the change in pH.

The nonionic monomer having a solubility parameter of 20.5 (hereinafter, the unit $(MPa)^{1/2}$ will be omitted for simplification.) or less constituting the copolymer (A) according to the invention may be a saturated or unsaturated monomer. The nonionic monomer is particularly preferably an unsaturated monomer, and examples thereof include alkyl (meth) acrylic acid of 1 to 40 carbons, preferably alkyl esters of 2 to 24 carbons, vinyl alcohol of 1 to 40 carbons, preferably alkyl acid esters of 2 to 24 carbons, alkyl-modified (meth) acrylamides of 2 to 40 carbons, preferably of 3 to 24 carbons; alkoxy-modified (meth) acrylamides of 2 to 40 carbons, preferably of 3 to 24 carbons, mono- or di-alkyl esters of maleic acid of 1 to 40 carbons; mono- or di-alkyl esters of fumaric acid of 1 to 40 carbons; styrene, vinyltoluene, α-methylstyrene, ethylene, propylene, butadiene, polyalkylene glycol meth) acrylates, alkoxy polyalkylene glycol(meth)acrylates, polyalkylene glycol alkenylethers, alkoxy polyalkylene glycol alkenylethers, and the like.

The anionic monomer constituting the copolymer (A) according to the invention is preferably an unsaturated monomer, and examples thereof include sodium salts, potassium salts, ammonium salts and other salts of monocarboxylic acids such as (meth) acrylic acid and crotonic acid; dicarboxylic acids such as maleic acid, fumaric acid, itaconic acid, and muconic acid, or the half esters thereof; and organic sulfonic acids such as vinylsulfonic acid, styrenesulfonic acid, and 2-acrylamide-2-methylpropanesulfonic acid and the like.

The cationic monomer constituting the copolymer (A) according to the invention is preferably an unsaturated monomer, and the examples thereof include dimethylaminoethyl (meth) acrylate, diethylaminoethyl (meth) acrylate, dimethylaminopropyl (meth) acrylamide, diethylaminopropyl (meth) acrylamide, allylamine, diallylamine, and triallylamine, or the salts thereof with an inorganic or organic acid such as hydrochloric acid, sulfuric acid, acetic acid, phosphoric acid, or the like; and vinyl monomers having a quaternary ammonium salt obtained in a reaction with a quaternarizing agent such as methyl halide chloride, bromide, etc.), ethyl halide (chloride, bromide, etc.), benzyl halide (chloride, bromide, etc.), dialkyl (methyl, ethyl, etc.) sulfate, dialkyl (methyl, ethyl, etc.) carbonate, or epichlorohydrin. Dimethylaminoethyl (meth) acrylate, diethylaminoethyl (meth) acrylate, dimethylaminopropyl (meth) acrylamide, diethylaminopropyl (meth) acrylamide, allylamine, diallylamine, or triallylamine may be used after treated with a salt of an inorganic or organic acid such as hydrochloric acid, sulfuric acid, acetic acid, or phosphoric acid or the like after copolymerization.

In addition, a crosslinking monomer maybe used partially in the unsaturated monomer constituting the copolymer (A), for improvement in paper strength. The crosslinkable monomer may or may not be one of the nonionic unsaturated monomer having a solubility parameter of 20.5 or less, the anionic monomer, the cationic monomer, and the nonionic unsaturated monomer having a solubility parameter of 26.6 or more described above. Further a monomer not belonging to the above may be used. The degree of crosslinking depends significantly on molar ratio, and the ratio of the crosslinkable monomer is preferably 0.001 to 5 mole %, more preferably 0.01 to 1 mole %, and particularly preferably 0.05 to 0.5 mole % with respect to the entire constituting monomers. Examples of the crosslinkable monomers include bifunctional crosslinkable monomers such as methylene bis (meth) acrylamide, ethylene bis (meth) acrylamide, hexamethylene bis (meth) acrylamide, ethylene glycol di (meth) acrylate, diethylene glycol di (meth) acrylate, triethylene glycol di (meth) acrylate, polyethylene glycol di (meth) acrylate, divinylbenzene, and diallyl (meth) acrylamide; multifunctional crosslinkable monomers such as 1,3,5-triacryloyl hexahydro-S-triazine, triallyl isocyanurate, pentaerythritol triacrylate, trimethylolpropane acrylate, triacryl folmal, diacryloylimide; and the like.

In regard to the monomer composition of the copolymer (A) according to the invention, the content of the nonionic monomer having a solubility parameter of 20.5 or less is preferably 5 to 84%, more preferably 10 to 70%, and still more preferably, 15 to 60%, and particularly preferably 20 to 50% by weight, from the viewpoints of improvement in bulky value, opacity and brightness and in improvement in paper strength. The total content of the anionic monomer and/or cationic monomers is preferably 1 to 80%, more preferably 3 to 50%, and particularly more preferably, 5 to 30% by weight; and the content of the nonionic unsaturated monomer having a solubility parameter of 26.6 or more is preferably 15 to 94%, more preferably 20 to 80%, and particularly preferably, 40 to 70% by weight.

The composition above may be a composition of the monomers when supplied before polymerization.

A combination of an nonionic monomer having a solubility parameter of 20.5 or less in an amount of 5 to 84% by weight, a total of anionic and cationic monomers in an amount of 1 to 80% by weight, and a nonionic unsaturated monomer having a solubility parameter of 26.6 or more in an amount of 15 to 94% by weight is preferable as the ratio of the constituent monomers of copolymer (A).

In addition, the copolymer (A) according to the invention preferably has a weight-average molecular weight of 1,000 to 10,000,000, more preferably 5,000 to 5,000,000, and particularly preferably, 10,000 to 2,000,000, from the viewpoints of uniform absorbency onto pulp fiber, solubility in water, and uniform dispersibility before papermaking step. The weight-average molecular weight of the copolymer (A) is a value determined by GPC under the condition described below, either of reagent-grade polyacrylamide or polyethylene glycol (standard sample used in GPC) may be used for reference in molecular weight, and the copolymer (A) preferably satisfies the requirement in the range of molecular weight described above. The reference reagent is preferably polyethylene glycol. The molecular weight favorable from the viewpoint of bulky value is 10,000 to 300,000 as polyacrylamide, and 5,000 to 150,000 as polyethylene glycol. The molecular weight favorable from the viewpoint of paper strength is 40,000 to 1,010,000 as polyacrylamide and 20,000 to 500,000 as polyethylene glycol.

[Measuring Conditions]

Column: α−M×2 (Toso Corporation)

Eluant: 50 mM LiBr, 1% acetic acid/ethanol=70/30 (volume ratio)

Flow rate: 1 mL/min

Column temperature: 40° C.

Detector: RI

Sample concentration: 4 mg/mL

Injection: 100 μL.

Methods of polymerizing the copolymer (A) according to the invention are not particularly limited, and include, for example, known polymerization methods such as solution polymerization by using a polymerization initiator, mass polymerization, and the like. The polymerization may be carried out batchwise or continuously; the solvent that is added as needed at the time is not particularly limited, and any known solvent may be used. Examples of the solvents include water; alcohols such as methyl alcohol, ethyl alcohol, and isopropyl alcohol; aromatic or aliphatic hydrocarbons such as benzene, toluene, xylene, cyclohexane, and n-heptane; esters such as ethyl acetate; ketones such as acetone and methylethylketone; and the like. It is preferable to use one or more solvents selected from the group consisting of water and lower alcohols having 1 to 4 carbons, from the points of the solubility of the monomer mixtures and the resulting copolymer (A).

The polymerization initiator is not particularly limited and any known initiator may be used. Examples of the polymerization initiators include persulfate acid salts such as ammonium persulfate, sodium persulfate, and potassium persulfate; hydrogen peroxide; azo compounds such as azobis-2-methylpropionamidine hydrochloride salt and azoisobutylonitrile; peroxides such as benzoyl peroxide, lauroyl peroxide, and cumene hydroperoxide; and the like, and the polymerization initiators may be used alone or in combination of two or more. At the time, one or more of reducing agents, such as sodium bisulfite, sodium sulfite, Mohr's salt, sodium pyrobisulfite, sodium formaldehyde sulfoxylate, and ascorbic acid; amine compounds such as ethylenediamine, sodium ethylenediaminetetraacetate, and glycine; and the like, may be used together as accelerators.

A chain transfer agent may also be used in combination as needed. The chain transfer agent is not particularly limited and any known agent may be used, and examples thereof include mercaptoethanol, mercaptoglycerin, mercaptosuccinic acid, mercaptopropionic acid, mercaptopropionic acid 2-ethylhexylester, octanoic acid 2-mercaptoethylester, 1,8-dimercapto-3,6-dioxaoctane, decanetrithiol, dodecylmercaptan, hexadecanethiol, decanethiol, carbon tetrachloride, carbon tetrabromide, α-methylstyrene dimer, terpinolene, α-terpinene, γ-terpinene, depentene, 2-aminopropan-1-ol, and the like, and these compounds may be use alone or in combination of two or more.

The polymerization temperature varies according to the polymerization method, solvent, polymerization initiator, and chain transfer agent used, but is usually in the range of 0 to 150° C.

The resulting polymer may be separated by removing solvents for example by drying the reaction product obtained after polymerization under reduced pressure and pulverizing the dried product.

In the invention, the surfactant (B) is a surfactant different from the copolymer (A) and the water-soluble polymer (C) described below; any compound that has a hydrophobic interaction with the constituent unit having a solubility parameter of 20.5 or less in the copolymer (A) may be used as the surfactant (B); but the surfactant (B) preferably has a structure containing an alkyl group having two or more carbons, preferably 3 to 40, and still more preferably 4 to 24 and a molecular weight or a number-average molecular weight if the compound has the distribution similar to a polyoxyalkylene glycol in the range of 50 to 10,000 or 100 to 5,000.

The surfactant (B) is either an anionic, cationic, nonionic, or amphoteric surfactant, and preferably has a structure that has no interaction with the ionic constituent group of the copolymer (A), and more preferably a nonionic structure.

The surfactant (B) has an HLB in the range of −5 to 15 and more preferably in the range of 2.1 to 12. The HLB in the invention is defined by the following equation:

$$HLB=\Sigma(\text{hydrophilic group number})+\Sigma(\text{lipophilic group number})+7$$

In the invention, the $HLB_M$ group numbers shown in Tables 2 and 3 of Tenside Surfactant Deterg. VOL. 29, No. 2, pages 109-113 (1993) are used as the lipophilic and hydrophilic group numbers above. An $HLB_M$ group number shown in Table 2 is used for a lipophilic group, while an $HLB_M$ group number in Table 3 for a hydrophilic group. However, a hydrophilic group number of +12.3 is used for a phosphate ester such as $—OPO(O^-)_2$, $(—O)_2POO^-$, or $(—O)_3PO$.

In regard to the surfactant (B), examples of the anionic surfactant include alkyl sulfate salts, polyoxyalkylenealkylether sulfate salts, fatty acids and the salts thereof, and the like. Examples of the cationic surfactants include alkyltrimethylammonium chlorides, dialkyldimethylammonium chlorides, benzalkonium chloride, alkylamine acid salts, and the like. Examples of the nonionic surfactants include fatty esters of a polyvalent alcohol and the alkylene oxide adducts of the fatty esters of polyvalent alcohol; fatty amides and the alkylene oxide adducts of the fatty amides; alkylene oxide adducts of an alkylamine; alcohols and/or the alkylene oxide adducts of the alcohols; polyalkylene glycols having an oxyalkylene group having 2 to 4 carbons, preferably having an oxyalkylene group having 3 to 4 carbons as the constituent unit; and the like. Examples of the ampholytic surfactants include alkyl trimethylamino acetic acid betaine, alkyldimethylamine oxide, alkyl carboxymethyl hydroxyethyl imidazolium betaine, alkylamide propyl betaine, alkyl hydroxy sulfobetaine; and the like. Among the alkylene oxide adducts of an alcohol having 2 to 40 carbons, preferably having 4 to 24 carbons, an alkylene oxide adduct containing an alkylene oxide group having 2 to 4 carbons in an amount of more than 0 and less than 150 moles on average per 1 mole of the alcohol is preferable, and an alkylene oxide adduct containing an alkylene oxide group having 2 to 4 carbons in an amount of more than 0 and less than 50 moles per 1 mole of the alcohol on average is more preferably. In addition, a water-soluble surfactant is preferable as the surfactant (B) for improvement in paper strength. In the invention, the fact that the surfactant (B) is water-soluble means that the aqueous solution containing the surfactant (B) at a concentration of 1% by weight is transparent at 25° C.

In the invention, the fact that the surfactant (B) is water-soluble means that the aqueous solution containing the surfactant (B) at a concentration of 1% by weight is transparent at 25° C., which in turn means that the transmittance (%) of a visible light at 660 nm through the aqueous solution placed in a cell having an optical path of 10 mm is 90% or more with reference to 100% of pure water. A surfactant (B) seemingly insoluble or not soluble in water at room temperature is subjected to a test for confirming the solubility in an aqueous solution beforehand, by adding the surfactant in water at a concentration of 1% by weight, stirring the mixture at 80° C. for 30 minutes, and allowing the mixture to cool to room temperature (25° C.) while maintaining the stirring.

The weight ratio (A)/(B) of the copolymer (A) to the surfactant (B) in the paper quality improver for papermaking according to the invention is 99/1 to 1/99, preferably 95/5 to 5/95, and still more preferably 85/15 to 15/85. Preferably, the mixture of copolymer (A) and surfactant (B) is water-soluble.

The paper quality improver for papermaking according to the invention may additionally contain a water-soluble polymer (C) at least satisfying one of the conditions: a weight-average molecular weight of 1,000 to 10,000,000, preferably 10,000 to 10,000,000, and a viscosity at 25° C. as determined in an 1% aqueous solution of 1 to 4,000 mPa·s, preferably 2 to 2,000 mPa·s, and still more preferably 3 to 1,000 mPa·s. The water-soluble polymer (C) having a weight-average molecular weight or a viscosity in this range is superior in improving the paper strength. The weight-average molecular weight of the water-soluble polymer (C) and the viscosity thereof as determined in an 1% aqueous solution are determined according to the following methods:

<Method of Determining Weight-Average Molecular Weight>

The weight-average molecular weight of the water-soluble polymer (C) was determined by GPC under the condition described below. Pullulan was used for molecular weight conversion.

[Measuring Conditions]
Column; α–M×2 (Tosoh Corporation)
Eluant: 0.15 M $Na_2SO_4$/1% acetic acid
Flow rate: 1 mL/min
Column temperature: 40° C.
Detector: RI
Sample concentration: 2 mg/mL
Injection: 100 μL.

<Method of Determining Viscosity>

An aqueous solution containing the water-soluble polymer (C) at a concentration of 1% by weight was prepared and the viscosity thereof was determined under the condition of 25° C. by using a type B viscometer (manufactured by Tokyo Keiki). The rotational frequency was 60 r/min, and one of the following four rotors are used according to viscosity: No. 1 rotor for a solution having a viscosity in the range of 80 mPa·s or less; No. 2 rotor, more than 80 mPa·s and 400 mPa·s or less; No. 3 rotor, more than 400 mPa·s and 1,600 mPa·s or less; and No. 4 rotor, more than 1,600 mPa·s and 8,000 mPa·s or less.

The water-soluble polymer (C) is not included in the copolymer (A) or surfactant (B), and examples thereof include polyvinyl alcohol-based polymers, polyacrylamide-based polymers, polyethyleneimine, urea formaldehyde resins, melamine formaldehyde resins, epoxidized polyamide resins, carboxymethylcellulose, starch and denatured starches, vegetable gums, and the like, and among them, one or more compounds selected from the group consisting of polyacrylamide-based polymers, polyvinyl alcohol-based polymers, starches and denatured starches, and vegetable gums are preferable.

The starches include, for example, natural starches such as corn starch, potato starch, wheat starch, tapioca starch, and the like. The denatured starches are the processed starches described on pages 36 to 37 of "Dictionary of the Chemicals for Paper and Paper Making" (published by TechTimes, in 1991) that are processed physically and/or chemically, and in particular, for example, oxidized starches processed with an oxidant such as sodium hypochlorite, a periodic acid salt, or the like and cationic starches having a cationic group such as 3-chloro-2-hydroxypropyltrimethylammonium chloride, glycidyl trimethylammonium chloride, diethylaminoethyl chloride hydrochloride salt, or the like introduced in the molecule are preferable. As described on page 283 of the "Dictionary of the Chemicals for Paper and Paper Making", denatured starches further having a phosphate group introduced in the cationic starches, sometimes called ampholytic starches, are also included in the invention. In particular, use of a cationic starch allows increase in paper strength, without the sacrifice of deterioration in bulking effect when the addition amount is increased, and thus is more preferable. Further, the degree of cationic substitution of the cationic starch is preferably 0.005 to 0.1 and more preferably 0.01 to 0.08. The degree of cationic substitution of a cationic starch is the average number of the cationic group-introduced hydroxyl groups with respect to the total hydroxyl groups contained in the glucose residue constituting the cationic starch, and is three when the cationic substituents are introduced onto all hydroxyl groups.

When the water-soluble polymer (C) is contained in the paper quality improver for papermaking according to the invention, the weight ratio of the copolymer (A) and surfactant (B) to the water-soluble polymer (C), [copolymer (A)+surfactant (B)]/water-soluble polymer (C), is preferably is preferably 99/1 to 10/90, and more preferably 98/2 to 20/80.

The paper quality improver for papermaking according to the invention, i.e., the copolymer (A) and surfactant (B), or alternatively the copolymer (A), the surfactant (B) and the water-soluble polymer (c), may be added as a mixture in the papermaking step or separately in the papermaking step. In particular, the copolymer (A) and the surfactant (B) are added preferably as a mixture.

The paper quality improver for papermaking according to the invention is added anywhere in the papermaking step, and may be added as it is or as diluted in water or the like as needed.

The paper quality improver for papermaking according to the invention is applicable to a wide range of pulps: virgin pulps including mechanical pulps such as thermomechanical pulps (TMP) and chemical pulps such as LBKP, and pulp materials such as waste paper pulps, and the like. If a waste paper pulp is blended, the blending amount in the raw pulps is preferably 10% by weight or more and more preferably 30% by weight or more.

The paper quality improver for papermaking according to the invention is added in any step before the papermaking step (internal addition). The improver is favorably added anywhere before the papermaking step when a paper layer is formed while water in the dilute solution of the pulp material is filtered through a wire while moving thereon, for example, in a macerator or beater such as pulper and refiner, a tank such as a machine chest, head box, or white water tank, or a pipe connected to one of these facilities, but favorably at a site where the improver can be blended to the pulp material uniformly, such as refiner, machine chest, or head box. The paper quality improver for papermaking according to the invention is preferably be papermade as it is after added into the pulp material, and mostly contained in the pulp sheet.

The papermaking speed of the pulp sheet that contains the quality improver according to the invention is added thereto is preferably 200 m/min or more, more preferably 300 m/min or more, and still more preferably 500 m/min or more, from the viewpoint of exerting a drastic effect on improvement in bulky value, brightness, and opacity.

A sizing agent, filler, yield improver, water-filtration improver, paper strength improver, or the like may be added thereto during papermaking. In particular, binding of the paper quality improver for papermaking according to the invention onto the pulp is extremely important for exerting the action of the improver, and addition of a binding accelerator is preferable for that purpose. Examples of the binding accelerators include aluminum sulfate, compounds having an acrylamide group, polyethyleneimine, and the like. The amount of the binding accelerator added is preferably 0.01 to 5 parts by weight with respect to 100 parts by weight of the pulp material. In particular, when a copolymer (A) having an anionic constituent unit is used, combined used of a binding accelerator will be effective in exerting the advantageous effects.

The paper quality improver for papermaking according to the invention is preferably added in an amount of 0.01 to 10 parts by weight with respect to 100 parts by weight of the pulp material, but even smaller addition particularly at 0.1 to 5 parts by weight is effective in improving at least one bulking-improving effect, optical property in brightness, opacity, or the like.

The paper quality improver for papermaking according to the invention may be used as a paper bulky value improver, a paper brightness improver, or a paper opacity improver.

The pulp sheet obtained by using the paper quality improver for papermaking according to the invention preferably has an bulk density, an indicator of bulky value, lower by 0.02 g/cm$^3$ or more, preferably 0.03 g/cm$^3$ or more, a brightness higher by 0.5 point or more, preferably 0.6 point or more, and an opacity higher by 1.0 point or more, preferably 1.2 point or more than those of the additive-free sheet. Further, the pulp sheet preferably satisfies two or more of the requirements above, and more preferably all three requirements.

The paper quality improver according to the invention allows improvement in bursting strength while improving at least one of the bulky value, brightness, and opacity of the sheet. The bursting strength has correlations with the other paper strength properties of sheet such as tensile strength, tear strength, and interlayer strength, and the evaluation of the bursting strength provides these indicators. In the invention, the standard improved ratio in burst index described above is preferably −3,000 or more, more preferably −1,500 or more, still more preferably, −500 or more, and particularly preferably, 0 or more, from the viewpoint of the paper strength demanded from operation and product processing and for use as product.

The pulp sheet obtained by using the paper quality improver for papermaking according to the invention can be favorably used as the papers and cardboards such as wound newspaper, printing and document paper, and packaging paper, which are included in the Product Classification described on pages 455 to 460 of "Handbook of Paper and Pulp Technology" (published by Japan TAPPI, 1992).

The invention provides a paper quality improver for papermaking that leads to the improvement at least in bulky value, brightness, or opacity, which is demanded by reduction in the weight of paper and increased use of a waste paper pulp, and to the improvement in paper strength even when added in a smaller amount. In addition, the paper quality improver for papermaking according to the invention provides a pulp sheet improved in bulky value, brightness, and opacity, as well as paper strength.

EXAMPLE

In the following examples, "parts" represents parts by weight and "%", % by weight unless otherwise indicated.

<Preparation of Copolymer (A)>

(I) Preparation of No. A-1 Copolymer

In a glass reaction container equipped with a thermometer, a stirrer, a dropping funnel, a nitrogen-supplying tube, and a reflux condenser, were placed 592.3 parts of ethanol, 14.5 parts of water, 58.0 parts of the quaternary ammonium salt from dimethylaminoethyl methacrylate and methyl chloride (QDM), and 240 parts of methoxypolyalkylene glycol methacrylate (ethylene oxide/propylene oxide: 5/10 (molar ratio), random adduct) (MEPAGMA), and the container was purged with nitrogen. After the mixture was heated to 67° C. under a nitrogen atmosphere, 84.8 parts of a 2% ethanol solution of 2,2'-azobis(2,4-dimethylvaleronitrile) (V-65) was added dropwise over a period of 90 minutes. After the mixture was left at the same temperature for 1 hour, 10.4 parts of a 4% ethanol solution of 2,2'-azobis(2,4-dimethylvaleronitrile) was additionally added dropwise thereto over a period of 30 minutes, and the mixture was allowed to stand at the same temperature for 2 hours, and then cooled, to give No. A-1 copolymer solution containing a polymer having a weight-average molecular weight (as polyacrylamide) of 140,000.

No. A-2 copolymer was prepared in a similar manner to the polymerization method for the preparation of No. A-1 copolymer.

(II) Preparation of No. A-3 Copolymer

In a glass reaction container equipped with a thermometer, a stirrer, a dropping funnel, a nitrogen-supplying tube, and a reflux condenser, were placed 203.9 parts of ethanol and 167.5 parts of water, and the container was purged with nitrogen. To the mixture, which had been previously heated to 67° C. under nitrogen atmosphere, a 75% aqueous solution containing 72.9 parts of an aqueous solution containing a quaternary ammonium salt from dimethylaminopropyl acrylamide and methyl chloride (DMAPAA-Q), 72.8 parts of tertiary-octyl acrylamide (t-OAAm), 144.1 parts of acrylamide (AAm), 161.1 parts of ethanol, and 107.4 parts of water, and 73.2 parts of a 2% aqueous solution containing 2,2'-azobis(2-amidinopropane)dihydrochloride (V-50) were added dropwise simultaneously, respectively over a period of 90 minutes. The mixture was then left at the same temperature for 3 hours and cooled, to give No. A-3 copolymer solution containing a polymer having a weight-average molecular weight (as polyacrylamide) of 30,000.

(III) Preparation of No. A-4 Copolymer

In a glass reaction container equipped with a thermometer, a stirrer, a dropping funnel, a nitrogen-supplying tube, and a reflux condenser, 375 parts of ethanol were placed 310.4 parts of water, 67.8 parts of a 75% aqueous solution of DMAPAA-Q, 67.7 parts of t-OAAm, 131.2 parts of AAm were placed, and the container was purged with nitrogen. The mixture was then heated to 62° C. under a nitrogen atmosphere, and 48 parts of an aqueous 0.7% V-50 solution was added thereto dropwise over a period of 90 minutes at the same temperature. The mixture was left at the same temperature for 6 hours and then cooled, to give No. A-4 copolymer solution containing a polymer having a weight-average molecular weight (as polyacrylamide) of 180,000.

Copolymers Nos. A-5 to A-10 were prepared in a similar manner to the polymerization method for preparation of No. A-4 copolymer.

The copolymers (A) thus obtained, the monomer compositions, and weight-average molecular weights thereof are summarized in Table 1. The surfactants (B) used are summarized in Table 2. The water-soluble polymers (C) obtained and the weight-average molecular weights or the viscosities in a 1% aqueous solution thereof are summarized in Table 3. In addition, the standard improved bulky value, standard brightness, and standard opacity, and standard improved ratio in burst index of each of the paper quality improvers prepared in the compositions shown in Table 4 (parts with respect to 100 parts of pulp) is shown in Table 4.

<Paper Quality Improver for Papermaking>

Aqueous solutions respectively containing effectively 1% in concentration of a copolymer (A) shown in Table 1, a surfactant (B) shown in Table 2, and a water-soluble polymer shown in Table 3 were prepared, and were used as they were according to the desired composition. When the surfactant (B) is not water-soluble, or when the mixture of the 1% aqueous solutions of the copolymer (A) and the surfactant (B) is not water-soluble, the surfactant (B) was added to the 1% aqueous solution of copolymer (A), and the mixture was diluted with water to a solid surfactant (B) concentration of 1%, and the resulting mixture was stirred at 80° C. for 30 minutes and the allowed to cool to room temperature while stirred; and the resulting dispersion was used for test.

TABLE 1

| Copolymer No. | Monomer (I) | Monomer (II) | Monomer (III) | Monomer (IV) | Weight ratio of (I)/(II)/(III) | monomer (IV) ratio (mole %) | Weight average molecular weight: converted into polyacrylamide | Weight average molecular weight: converted into polyethylene glycol |
|---|---|---|---|---|---|---|---|---|
| | Monomer composition of copolymers | | | | | | | |
| A-1 | MEPAGMA | QDM | — | — | 80/20/0 | — | 140000 | 60000 |
| A-2 | 2EHA | MOEDES | DMAAm | — | 24/16/60 | — | 140000 | 65000 |
| A-3 | t-OAAm | DMAPAA-Q | AAm | — | 27/20/53 | — | 30000 | 15000 |
| A-4 | t-OAAm | DMAPAA-Q | AAm | — | 27/20/53 | — | 180000 | 90000 |
| A-5 | t-OAAm | DMAPAA-Q | AAm | — | 10/23/67 | — | 250000 | 125000 |
| A-6 | t-OAAm | DMAPAA-Q | AAm | — | 19/22/59 | — | 240000 | 120000 |
| A-7 | t-OAAm | DMAPAA-Q | AAm | — | 34/17/47 | — | 150000 | 75000 |
| A-8 | t-OAAm | DMAPAA-Q | AAm | MBAAm | 27/20/53 | 0.2 | 1090000 | 470000 |
| A-9 | t-OAAm | DMAPAA-Q | AAm | TAC | 27/20/53 | 0.1 | 290000 | 140000 |
| A-10 | BMA | MOEDES | AAm | — | 20.2/29.4/50.4 | — | — | 25000 |

Monomer (I): Nonionic unsaturated monomer having a solubility parameter of 20.5 $(MPa)^{1/2}$ or less
Monomer (II): Anionic or cationic monomer
Monomer (III): Nonionic unsaturated monomer (excluding DMMAm) having a solubility parameter of 26.6 $(MPa)^{1/2}$ or more
Monomer (IV): Crosslinkable monomer Monomer (I) : Nonionic unsaturated monomer having a solubility parameter of 20.5 $(MPa)^{1/2}$ or less, Monomer (II): Anionic or cationic monomer Monomer (III) : Nonionic unsaturated monomer (excluding DMMAm) having a solubility parameter of 26.6 $(MPa)^{1/2}$ or more Monomer (IV): Crosslinkable monomer MEPAGMA: Methoxypolyalkylene glycol methacrylate (solubility parameter: 17.6, ethylene oxide/propylene oxide: 5/10 (molar ratio), random adduct)

2EHA: 2-Ethylhexyl acrylate (solubility parameter: 16.0)

t-OAAm: Tertiary-octyl acrylamide (solubility parameter: 16.6)

BMA: n-Butyl methacrylate (solubility parameter: 16.8)

QDM: Quaternary ammonium salt from dimethylaminoethyl methacrylate and methyl chloride MOEDES: Quaternary ammonium salt from dimethylaminoethyl methacrylate and diethyl sulfate DMAPAA-Q; Quaternary ammonium salt from dimethylaminopropyl acrylamide and methyl chloride DMAAm: Dimethyl acrylamide (solubility parameter: 21.7)

AAm: Acrylamide (solubility parameter: 30.1)

MBAAm: Methylene bisacrylamide

TAG: Triallyl isocyanurate

TABLE 2

| No. | Compound name | HLB | Water solubility | Transmittance (%) |
|---|---|---|---|---|
| B-1 | Lauryl alcohol adduct of block copolymer $EO_{2.5}PO_{1.5}EO_3$ (lauryl alcohol:lauryl alcohol/myristyl alcohol: 7/3, weight ratio) | 3.7 | ○ | 99 |
| B-2 | Lauryl alcohol adduct $EO_{23}$ | 10.4 | ○ | 100 |
| B-3 | Diethylene glycol monobutylether | 6.7 | ○ | 100 |

TABLE 2-continued

| No. | Compound name | HLB | Water solubility | Transmittance (%) |
|---|---|---|---|---|
| B-4 | Lauryl alcohol adduct of $PO_5$ | 1.6 | X | 3 |
| B-5 | Stearyl alcohol adduct of $EO_6$ | 1.5 | X | 1 |
| B-6 | Stearic monoglyceride | 2.0 | X | 0 |
| B-7 | Pentaerythritol stearate (average degree of ester substitution: 45 equivalance %) | −3.3 | X | 0 |
| B-8 | Stearyltrimethylammonium chloride | 5.2 | ○ | 100 |
| B-9 | Lauric acid amide propyl betaine | 5.4 | ○ | 100 |
| B-10 | Sodium laurysulfate | 13.2 | ○ | 99 |

In the table, EO represents ethylene oxide and PO, propylene oxide; and the number represents the average number of polymerization moles.

"O" in the water solubility column means water soluble, and "x" water insoluble.

TABLE 3

| No. | Water soluble polymer |
|---|---|
| C-1 | Ampholytic polyacrylamide (Harima Chemicals, Inc, Harmide EX113, weight-average molecular weight: 2,000,000) |
| C-2 | Cationic starch [National Starch and Chemical Co., Cato308, 1% aqueous solution, viscosity: 151 mPas · s (25° C.)] |

TABLE 4

| Paper quality improver No. | Composition: Copolymer (A) kind | Copolymer (A) addition amount (parts by weight) | Surfactant (B) kind | Surfactant (B) addition amount (parts by weight) | Water soluble polymer (C) kind | Water soluble polymer (C) addition amount (parts by weight) | properties: standard improved bulky value ($g/cm^3$) | standard improved brightness (point) | standard improved opacity (point) | standard improved ratio in burst index (%) |
|---|---|---|---|---|---|---|---|---|---|---|
| Product invention | | | | | | | | | | |
| 1 | A-1 | 1.0 | B-1 | 1.0 | — | — | 0.0530 | 0.0 | 2.6 | −897 |
| 2 | A-2 | 1.0 | B-1 | 1.0 | — | — | 0.0530 | 0.4 | 1.4 | −600 |
| 3 | A-3 | 1.0 | B-1 | 1.0 | — | — | 0.0730 | 0.9 | 2.5 | −457 |
| 4 | A-4 | 1.0 | B-1 | 1.0 | — | — | 0.0770 | 0.7 | 2.7 | −438 |
| 5 | A-5 | 1.0 | B-1 | 1.0 | — | — | 0.0450 | 0.4 | 1.4 | −370 |
| 6 | A-6 | 1.0 | B-1 | 1.0 | — | — | 0.0560 | 0.6 | 2.5 | −380 |
| 7 | A-7 | 1.0 | B-1 | 1.0 | — | — | 0.0590 | 0.5 | 2.7 | −502 |
| 8 | A-8 | 1.0 | B-1 | 1.0 | — | — | 0.0610 | 0.9 | 2.4 | −394 |
| 9 | A-9 | 1.0 | B-1 | 1.0 | — | — | 0.0600 | 0.8 | 2.2 | −345 |
| 10 | A-4 | 1.0 | B-1 | 1.0 | C-1 | 1.0 | 0.0450 | 0.9 | 3.1 | 57 |
| 11 | A-4 | 1.0 | B-1 | 1.0 | C-2 | 1.0 | 0.0480 | 1.0 | 3.0 | 53 |
| 12 | A-3 | 1.0 | B-2 | 1.0 | — | — | 0.0420 | 0.6 | 1.9 | −417 |
| 13 | A-3 | 1.0 | B-3 | 1.0 | — | — | 0.0260 | 0.5 | 0.7 | −235 |
| 14 | A-3 | 1.0 | B-4 | 1.0 | — | — | 0.0770 | 1.2 | 3.2 | −730 |
| 15 | A-3 | 1.0 | B-5 | 1.0 | — | — | 0.0690 | 1.0 | 2.8 | −647 |
| 16 | A-3 | 1.0 | B-6 | 1.0 | — | — | 0.0670 | 1.2 | 3.4 | −701 |
| 17 | A-3 | 1.0 | B-7 | 1.0 | — | — | 0.0630 | 1.2 | 3.6 | −768 |
| 18 | A-3 | 1.0 | B-8 | 1.0 | — | — | 0.0420 | 0.4 | 1.9 | −224 |
| 19 | A-3 | 1.0 | B-9 | 1.0 | — | — | 0.0250 | 0.5 | 0.8 | −331 |
| 20 | A-3 | 1.0 | B-10 | 1.0 | — | — | 0.0210 | 0.4 | −0.3 | −406 |
| 21 | A-10 | 1.0 | B-1 | 1.0 | — | — | 0.0750 | 0.8 | 2.5 | −434 |
| Comparative product | | | | | | | | | | |
| 1 | A-4 | 2.0 | — | — | — | — | 0.0140 | 0.1 | 0.6 | 284 |
| 2 | — | — | B-1 | 2.0 | — | — | 0.0120 | 0.5 | −0.4 | −433 |
| 3 | — | — | — | — | C-1 | 1.0 | −0.0170 | −0.5 | −0.3 | Indefinable |
| 4 | — | — | — | — | C-2 | 1.0 | −0.0100 | −0.4 | 0.1 | Indefinable |
| 5 | — | — | B-1 | 2.0 | C-1 | 1.0 | −0.004 | −0.2 | −1.5 | Indefinable |
| 6 | blank (without any paper quality improver) | | | | | | — | — | — | Indefinable |

Example 1

(Pulp Material)

The following waste paper pulp and virgin pulp were used as pulp materials.

<Waste Paper Pulp>

A mixture of 1 part of sodium hydroxide, 3 parts of sodium silicate, 3 parts of a 30% hydrogen peroxide solution, and 0.3 part of DI-767 (manufactured by Kao Corporation) as deinking agent and 100 parts of municipal recovered waste paper (newspaper/flier: 70/30%) in hot water at 60° C. was macerated. The resulting pulp was treated with flotation, washed with water and adjusted in concentration to obtain a 0.4% deinked pulp slurry. The Canadian Standard Freeness thereof (JIS P3121) was 200 mL.

<Virgin Pulp>

A chemical pulp LBKP (bleached hardwood pulp) was beaten in a beater at 25° C., to give a 0.4% LBKP slurry. The Canadian Standard Freeness thereof (JIS P8121) was 410 mL.

(Papermaking Method −1)

After the concentration of the waste paper pulp slurry was adjusted to give a sheet having a pulp basis weight after papermaking of 55 $g/m^2$, the slurry was adjusted to pH 6.5 with aluminum sulfate. Each of the various paper quality improver for papermaking shown in Table 5 was then added to the pulp slurry, and a sheet was obtained by papermaking the slurry according to the method (1) for determining the standard improved bulky value. The addition amount shown in Table 5 is a value (% by weight) with respect to the pulp. The bulk density, brightness, opacity, and burst index of the sheet obtained were determined by the methods described below. Results are summarized in Table 5.

(Papermaking Method −2)

LBKP was suspended in an amount suitable for providing a sheet having a pulp basis weight of 84 $g/m^2$ after papermaking. Then, each of the various paper quality improver for papermaking shown in Table 6 was added to the pulp, and the slurry was papermade under a condition similar to the method (1) for determining the standard improved bulky value, to give a sheet. The addition amount shown in Table 6 is a value (% by weight) with respect to the pulp. The sheet was then evaluated in a similar manner to the papermaking method −1.

Results are summarized in Table 6.

<Evaluation Items and Methods>

Bulk Density

The basis weight and the thickness (mm) of the conditioned sheet (g/m$^2$) were determined, and the bulk density [g/cm$^3$] was calculated according to the following equation.

$$\text{Bulk density}=(\text{Basis weight})/(\text{Thickness})\times 0.001$$

The smaller the bulk density, the bulkier of the sheet, and a difference in bulk density of 0.02 may be regarded as significant.

Brightness

The brightness of the sheet was a Hunter brightness determined according to the method of JIS P8123. A difference in brightness of 0.5 point may be regarded as significant.

Opacity

The opacity of the sheet was determined according to the method of JIS P8138A. A difference in opacity of 0.5 point may be regarded as significant.

Bursting Strength

The bursting strength of the sheet was determined according to the method of JIS P8112, and the burst index was calculated by dividing the strength by the basis weight.

TABLE 5

| | Composition | | | | | | | | | |
|---|---|---|---|---|---|---|---|---|---|---|
| | Copolymer (A) | | Surfactant (B) | | Water soluble polymer (C) | | deinked pulp | | | |
| | kind | Addition amount (%) | kind | Addition amount (%) | kind | Addition amount (%) | Bulk density (g/cm$^3$) | Brightness (%) | Opacity (%) | Burst index [kPa/(g/m$^2$)] |
| Product of the invention | | | | | | | | | | |
| 1-1 | A-1 | 1.0 | B-1 | 1.0 | — | — | 0.382 | 57.5 | 92.6 | 1.17 |
| 1-2 | A-2 | 1.0 | B-1 | 1.0 | — | — | 0.384 | 57.6 | 92.1 | 1.43 |
| 1-3 | A-3 | 1.0 | B-1 | 1.0 | — | — | 0.367 | 58.3 | 93.1 | 1.49 |
| 1-4 | A-4 | 1.0 | B-1 | 1.0 | — | — | 0.361 | 58.1 | 93.7 | 1.66 |
| 1-5 | A-5 | 1.0 | B-1 | 1.0 | — | — | 0.387 | 57.7 | 92.2 | 1.86 |
| 1-6 | A-6 | 1.0 | B-1 | 1.0 | — | — | 0.377 | 57.9 | 92.7 | 1.76 |
| 1-7 | A-7 | 1.0 | B-1 | 1.0 | — | — | 0.370 | 58.0 | 92.8 | 1.57 |
| 1-8 | A-8 | 1.0 | B-1 | 1.0 | — | — | 0.378 | 58.2 | 93.0 | 1.88 |
| 1-9 | A-9 | 1.0 | B-1 | 1.0 | — | — | 0.374 | 58.1 | 93.0 | 1.77 |
| 1-10 | A-4 | 1.0 | B-1 | 1.0 | C-1 | 1.0 | 0.379 | 58.3 | 93.4 | 2.36 |
| 1-11 | A-4 | 1.0 | B-1 | 1.0 | C-2 | 1.0 | 0.386 | 58.3 | 92.8 | 2.40 |
| 1-12 | A-3 | 1.0 | B-2 | 1.0 | — | — | 0.387 | 57.9 | 92.9 | 1.85 |
| 1-13 | A-3 | 1.0 | B-3 | 1.0 | — | — | 0.399 | 57.6 | 92.1 | 2.10 |
| 1-14 | A-3 | 1.0 | B-4 | 1.0 | — | — | 0.362 | 58.4 | 93.9 | 0.98 |
| 1-15 | A-3 | 1.0 | B-5 | 1.0 | — | — | 0.368 | 58.2 | 93.6 | 1.24 |
| 1-16 | A-3 | 1.0 | B-6 | 1.0 | — | — | 0.369 | 58.4 | 93.6 | 1.18 |
| 1-17 | A-3 | 1.0 | B-7 | 1.0 | — | — | 0.372 | 58.4 | 93.9 | 1.16 |
| 1-18 | A-3 | 1.0 | B-8 | 1.0 | — | — | 0.387 | 57.7 | 92.7 | 2.03 |
| 1-19 | A-3 | 1.0 | B-9 | 1.0 | — | — | 0.400 | 57.8 | 92.1 | 2.05 |
| 1-20 | A-3 | 1.0 | B-10 | 1.0 | — | — | 0.405 | 57.7 | 91.4 | 2.08 |
| 1-21 | A-10 | 1.0 | B-1 | 1.0 | — | 0 | 0.363 | 58.2 | 93.6 | 1.71 |
| Comparative product | | | | | | | | | | |
| 1-1 | A-4 | 1.0 | — | — | — | — | 0.410 | 57.7 | 92.0 | 2.24 |
| 1-2 | — | — | B-1 | 1.0 | — | — | 0.414 | 57.7 | 91.3 | 2.14 |
| 1-3 | — | — | — | — | C-1 | 1.0 | 0.430 | 56.8 | 90.5 | 3.18 |
| 1-4 | — | — | — | — | C-2 | 1.0 | 0.426 | 56.9 | 91.3 | 2.99 |
| 1-5 | — | — | B-1 | 1.0 | C-1 | 1.0 | 0.424 | 57.2 | 90.8 | 3.08 |
| 1-6 | Blank (without any paper quality improver) | | | | | | 0.418 | 57.4 | 91.6 | 2.24 |

TABLE 6

| | Composition | | | | | | | | | |
|---|---|---|---|---|---|---|---|---|---|---|
| | Copolymer (A) | | Surfactant (B) | | Water soluble polymer (C) | | LBKP | | | |
| | kind | Addition amount (%) | kind | Addition amount (%) | kind | Addition amount (%) | Bulk density (g/cm$^3$) | Brightness (%) | Opacity (%) | Burst index [kPa/(g/m$^2$)] |
| Product of the invention | | | | | | | | | | |
| 2-1 | A-4 | 1.0 | B-1 | 0.3 | — | — | 0.535 | 81.7 | 88.0 | 2.80 |
| 2-2 | A-4 | 1.0 | B-1 | 0.5 | — | — | 0.527 | 82.2 | 88.0 | 2.64 |

TABLE 6-continued

| | Composition | | | | | | | | | |
|---|---|---|---|---|---|---|---|---|---|---|
| | Copolymer (A) | | Surfactant (B) | | Water soluble polymer (C) | | LBKP | | | |
| | kind | Addition amount (%) | kind | Addition amount (%) | kind | Addition amount (%) | Bulk density ($g/cm^3$) | Brightness (%) | Opacity (%) | Burst index [kPa/($g/m^2$)] |
| 2-3 | A-4 | 1.0 | B-1 | 1.0 | — | — | 0.511 | 82.4 | 89.0 | 2.22 |
| 2-4 | A-4 | 0.3 | B-1 | 1.0 | — | — | 0.527 | 82.4 | 87.6 | 2.40 |
| 2-5 | A-4 | 0.5 | B-1 | 1.0 | — | — | 0.521 | 82.4 | 87.8 | 2.40 |
| 2-6 | A-4 | 0.3 | B-1 | 0.3 | — | — | 0.545 | 82.0 | 86.7 | 2.82 |
| 2-7 | A-4 | 0.5 | B-1 | 0.5 | — | — | 0.534 | 82.0 | 87.5 | 2.71 |
| 2-8 | A-4 | 1.0 | B-1 | 1.0 | C-1 | 1.0 | 0.543 | 82.6 | 89.4 | 3.43 |
| 2-9 | A-10 | 1.0 | B-1 | 1.0 | — | 0.0 | 0.513 | 82.5 | 88.8 | 2.26 |
| Comparative product | | | | | | | | | | |
| 2-1 | A-4 | 3.0 | — | — | — | — | 0.578 | 82.1 | 86.9 | 3.48 |
| 2-2 | — | — | B-1 | 3.0 | — | — | 0.570 | 82.0 | 85.1 | 3.01 |
| 2-3 | — | — | — | — | C-1 | 1.0 | 0.605 | 81.2 | 86.0 | 4.81 |
| 2-4 | — | — | B-1 | 1.0 | C-1 | 1.0 | 0.592 | 81.5 | 84.8 | 4.61 |
| 2-5 | Blank (without any paper quality improver) | | | | | | 0.588 | 81.7 | 86.3 | 3.35 |

Blank (Without Any Paper Quality Improver)

As apparent from Tables 5 and 6, any of the paper quality improver for papermaking according to the invention provides a pulp sheet improved in bulky value, brightness, and opacity, and further in paper strength, either from waste paper pulp or virgin pulp (LBKP), Single addition of the copolymer (A) of comparative improver 1-1 or the surfactant (B) of comparative improver 1-2 shown in Table 5 was not effective in improving the bulky value, brightness, or opacity of the resulting sheet. In addition, single addition of the water-soluble polymer (C) of comparative improver 1-3 or 1-4 increases the paper strength relative to the blank, but deteriorates the bulky value, brightness, and opacity of the resulting sheet relative to the blank. Further, combined use of the surfactant (B) and the water-soluble polymer (C) of comparative improver 1-5 increases the paper strength relative to the blank, but deteriorates the bulky value, brightness, and opacity of the resulting sheet relative to the blank, similarly to the sheet containing comparative the improver 1-3 or 1-4.

Single addition of the copolymer (A) of comparative improver2-1 or the surfactant (B) of comparative improver2-2 shown in Table 6 was not effective in improving the bulky value, brightness, or opacity of the resulting sheet, even when the addition amount was increased. Alternatively, single addition of the water-soluble polymer (C) of comparative improver 2-3 increases the paper strength relative to the blank, but deteriorates the bulky value, brightness, and opacity of the resulting sheet relative to the blank. Combined use of the surfactant (B) of comparative improver 2-4 and the water-soluble polymer (C) increases the paper strength relative to the blank, but is not effective in improving the bulky value, brightness, opacity of the resulting sheet.

The invention claimed is:

1. A process of producing a pulp sheet, said process comprising:

adding a paper quality improver for papermaking to pulp in any step before a papermaking step of forming a paper layer while water in a dilute solution of a pulp material is filtered through a wire while moving thereon;

wherein the paper quality improver for papermaking comprises:

a copolymer (A) having the following constituent units:

10-34 weight % of nonionic unsaturated monomer, wherein said nonionic saturated monomer is tertiary-octyl acrylamide (t-OAAm);

17-23 weight % of an anionic or cationic monomer, wherein said anionic or cationic monomer is a quaternary ammonium salt from dimethylaminopropyl acrylamide and methyl chloride (DMAPAA-Q) or a quaternary ammonium salt from dimethylaminoethyl methacrylate and diethyl sulfate (MOEDES); and 47-67 weight % of a nonionic unsaturated monomer of acrylamide (AAm), and a surfactant (B) at an (A)/(B) ratio in the range of 85/15 to 15/85 (weight ratio), wherein a mixture of the copolymer (A) and the surfactant (B) is prepared by adding surfactant (B) to an aqueous solution of copolymer (A), wherein the paper quality improver provides at least one paper quality improving effect of the following (i), (ii), and (iii):

(i) standard improved bulky value: 0.02 $g/cm^3$ or more;

(ii) standard improved opacity: 1.0 point or more; and (iii) standard improved brightness: 0.5 point or more;

wherein the surfactant (B) is a water-soluble alcohol alkylene oxide adduct containing an alkylene oxide group having 2 to 4 carbons in an average amount of 5 to less than 150 moles per 1 mole of the alcohol; and wherein the paper quality improver provides a paper quality improving effect of a standard improved ratio in burst index of -502 or more.

2. A process of producing a pulp sheet according to claim 1, wherein one of the constituent monomers of copolymer (A) further comprises a crosslinkable constituent monomer.

3. A process of producing a pulp sheet according to claim 1, wherein the HLB of the surfactant (B) is in the range of -5 to 15.

4. A process of producing a pulp sheet according to claim 1, further comprising a water-soluble polymer (C) having at least one of a weight-average molecular weight of 1000 to 10,000,000 and a viscosity at 25 °C. in an 1% aqueous solution of 1 to 4,000 mPa·s.

5. A process of producing a pulp sheet according to claim 1, comprising the step of papermaking the pulp at a papermaking speed of 200 m/min or more.

6. A pulp sheet which is obtained by adding a paper quality improver for papermaking to pulp in any step before a papermaking step of forming a paper layer while water in a dilute solution of a pulp material is filtered through a wire while moving thereon;

wherein the paper quality improver for papermaking comprises:

a copolymer (A) having the following constituent units:

10-34 weight % of nonionic unsaturated monomer, wherein said nonionic saturated monomer is tertiary-octyl acrylamide (t-OAAm);

17-23 weight % of an anionic or cationic monomer, wherein said anionic or cationic monomer is a quaternary ammonium salt from dimethylaminopropyl acrylamide and methyl chloride (DMAPAA-Q) or a quaternary ammonium salt from dimethylaminoethyl methacrylate and diethyl sulfate (MOEDES); and 47-67 weight % of a nonionic unsaturated monomer of acrylamide (AAm), and a surfactant (B) at an (A)/(B) ratio in the range of 85/15 to 15/85 (weight ratio), wherein a mixture of the copolymer (A) and the surfactant (B) is prepared by adding surfactant (B) to an aqueous solution of copolymer (A);

wherein the paper quality improver provides at least one paper quality improving effect of the following (i), (ii), and (iii):

(i) standard improved bulky value: 0.02 g/cm $^3$ or more;

(ii) standard improved opacity: 1.0 point or more; and (iii) standard improved brightness: 0.5 point or more;

wherein the surfactant (B) is a water-soluble alcohol alkylene oxide adduct containing an alkylene oxide group having 2 to 4 carbons in an average amount of 5 to less than 150 moles per 1 mole of the alcohol; and wherein the paper quality improver provides a paper quality improving effect of a standard improved ratio in burst index of -502 or more.

7. A process of producing a pulp sheet according to claim 4, wherein the weight ratio of the copolymer (A) and surfactant (B) to a water-soluble polymer (C), which is [copolymer (A) +surfactant (B)]/[water-soluble polymer (C)], is 98/2 to 20/80.

8. A process of producing a pulp sheet according to claim 1, wherein the copolymer (A) has a weight-average molecular weight of 10,000 to 2,000,000, as determined when using polyethylene glycol as a standard sample in GPC (gel permeation chromatography).

9. A process of producing a pulp sheet according to claim 1, wherein the mixture of the copolymer (A) and the surfactant (B) is water-soluble.

10. A process of producing a pulp sheet according to claim 1, wherein said paper quality improver is blended with the pulp material in a refiner, machine chest or head box.

11. A method of improving paper quality, said method comprising:

adding a paper quality improver for papermaking to pulp in any step before a papermaking step of forming a paper layer while water in a dilute solution of a pulp material is filtered through a wire while moving thereon;

wherein the paper quality improver for papermaking comprises:

a copolymer (A) having the following constituent units:

10-34 weight % of nonionic unsaturated monomer, wherein said nonionic saturated monomer is tertiary-octyl acrylamide (t-OAAm);

17-23 weight % of an anionic or cationic monomer, wherein said anionic or cationic monomer is a quaternary ammonium salt from dimethylaminopropyl acrylamide and methyl chloride (DMAPAA-Q) or a quaternary ammonium salt from dimethylaminoethyl methacrylate and diethyl sulfate (MOEDES); and 47-67 weight % of a nonionic unsaturated monomer of acrylamide (AAm), and a surfactant (B) at an (A)/(B) ratio in the range of 85/15 to 15/85 (weight ratio), wherein a mixture of the copolymer (A) and the surfactant (B) is prepared by adding surfactant (B) to an aqueous solution of copolymer (A), wherein the paper quality improver provides at least one paper quality improving effect of the following (i), (ii), and (iii):

(i) standard improved bulky value: 0.02 g/cm $^3$ or more;

(ii) standard improved opacity: 1.0 point or more; and (iii) standard improved brightness: 0.5 point or more;

wherein the surfactant (B) is a water-soluble alcohol alkylene oxide adduct containing an alkylene oxide group having 2 to 4 carbons in an average amount of 5 to less than 150 moles per 1 mole of the alcohol; and wherein the paper quality improver provides a paper quality improving effect of a standard improved ratio in burst index of -502 or more.

12. The method of improving paper quality according to claim 11, wherein one of the constituent monomers of copolymer (A) further comprises a crosslinkable constituent monomer.

* * * * *